US005158016A

United States Patent [19]

Dubuit

[11] Patent Number: 5,158,016

[45] Date of Patent: Oct. 27, 1992

[54] TURRET TYPE PRINTING MACHINE

[75] Inventor: Jean-Louis Dubuit, Paris, France

[73] Assignee: Societe d'Exploitation des Machines Dubuit, Noisy Le Grand, France

[21] Appl. No.: 735,301

[22] Filed: Jul. 24, 1991

[30] Foreign Application Priority Data

Aug. 23, 1990 [FR] France ..... 90 10584

[51] Int. Cl.[5] ..... B41F 15/08

[52] U.S. Cl. ..... 101/123; 101/115

[58] Field of Search ..... 101/114, 115, 123, 126, 101/124

[56] References Cited

U.S. PATENT DOCUMENTS

| | | | |
|---|---|---|---|
| 2,484,671 | 10/1949 | Bauman | 101/115 X |
| 2,690,118 | 9/1954 | Schwartz et al. | 101/123 |
| 3,096,709 | 7/1963 | Eldred et al. | 101/115 |
| 4,750,419 | 6/1988 | Meredith | 101/124 X |
| 5,092,239 | 3/1992 | Bubley | 101/115 |

OTHER PUBLICATIONS

Satellite Advertisement.

*Primary Examiner*—Edgar S. Burr
*Assistant Examiner*—Christopher A. Bennett
*Attorney, Agent, or Firm*—Young & Thompson

[57] ABSTRACT

A printing machine comprises a frame and a turntable adapted to rotate on the frame to move objects to be printed along a displacement circumference. At least one silkscreen type printing head is aligned with the turntable and includes a support beam and, carried by the support beam, a screen support adapted to receive a screen and a squeegee carriage adapted to move relative to the screen support. The support beam extends along a line which is secant to the displacement circumference and is coupled to the frame at at least two points thereon disposed on respective sides of the displacement circumference. The squeegee carriage moves parallel to the support beam.

10 Claims, 3 Drawing Sheets

TURRET TYPE PRINTING MACHINE

BACKGROUND OF THE INVENTION

1. Field of the Invention

The present invention is generally concerned with turret type printing machines by which is meant printing machines including a turntable to support objects to be printed which is rotated stepwise on a frame and so forms a turret adapted to move said objects in a circular path around a circumference, referred to hereinafter for convenience only as the displacement circumference, the turntable comprising, equiangularly spaced along said circumference, a plurality of object supports each adapted to carry one object to be printed, at least one printing head being aligned with the turntable along the displacement circumference.

It is more particularly directed to silkscreen printing in which case the printing head comprises a screen support adapted to receive a screen and a squeegee carriage mounted to move relative to the screen support.

2. Description of the Prior Art

At present, the screen support and the squeegee carriage are carried by the same support beam extending in a straight line substantially tangential to the displacement circumference, the printing head as a whole lying essentially entirely outside the displacement circumference.

Preferably radial relative to the displacement circumference, the direction in which the squeegee carriage is movable is at present usually perpendicular to the support beam.

This arrangement has proved and may continue to prove satisfactory.

However, the squeegee is disposed cantilever fashion and the extent of its overhang is directly proportional to the displacement of the squeegee, compromising print quality.

A general object of the present invention is an arrangement whereby this disadvantage is avoided and other advantages are obtained.

SUMMARY OF THE INVENTION

The present invention consists in a printing machine comprising a frame, a turntable adapted to rotate on said frame to move objects to be printed along a displacement circumference, at least one silkscreen type printing head aligned with said turntable and including a support beam and, carried by said support beam, a screen support adapted to receive a screen and a squeegee carriage adapted to move relative to said screen support, said support beam of said printing head extending along a line that is parallel to and displaced from a diameter line of said displacement circumference and being coupled to said frame at least two points thereon disposed on respective sides of said displacement circumference, said squeegee carriage being adapted to move parallel to said support beam.

In a preferred embodiment of the invention, the printing head support team is articulated to the frame at a first point thereof and has a centering wedge bearing on a second point of said frame and is coupled to a lifting jack which, by moving the assembly to a raised position by simply pivoting it, advantageously provides easy access to the screen for cleaning, while strongly securing the assembly to the frame in the lowered position.

The working position of the screen is therefore particularly stable and accurate, with obvious advantages.

Because the direction of displacement of the squeegee carriage is parallel to the support beam, the minimal overhang of the squeegee advantageously remains constant over its full travel and therefore throughout printing.

This achieves better control of squeegee positioning and better control of the pressure with which it presses the screen against the object to be printed, to the benefit of print quality.

If cam means are provided between the screen support and the squeegee carriage to lift the screen progressively when the object to be printed is flat, the cam means are advantageously parallel to the support beam, with further benefit in terms of print quality.

Finally, apart from the simplicity of design resulting from the use of the same support beam to support the screen and the squeegee carriage, the fact that the support beam extends to either side of the displacement circumference minimizes the overall radial dimension of the system for the same print quality, again with obvious advantages.

By virtue of this arrangement, the printing head is at least in part accommodated within the displacement circumference.

The characteristics and advantages of the invention will emerge from the following description given by way of example only with reference to the appended diagrammatic drawings.

DETAILED DESCRIPTION OF THE INVENTION

Figure 1:
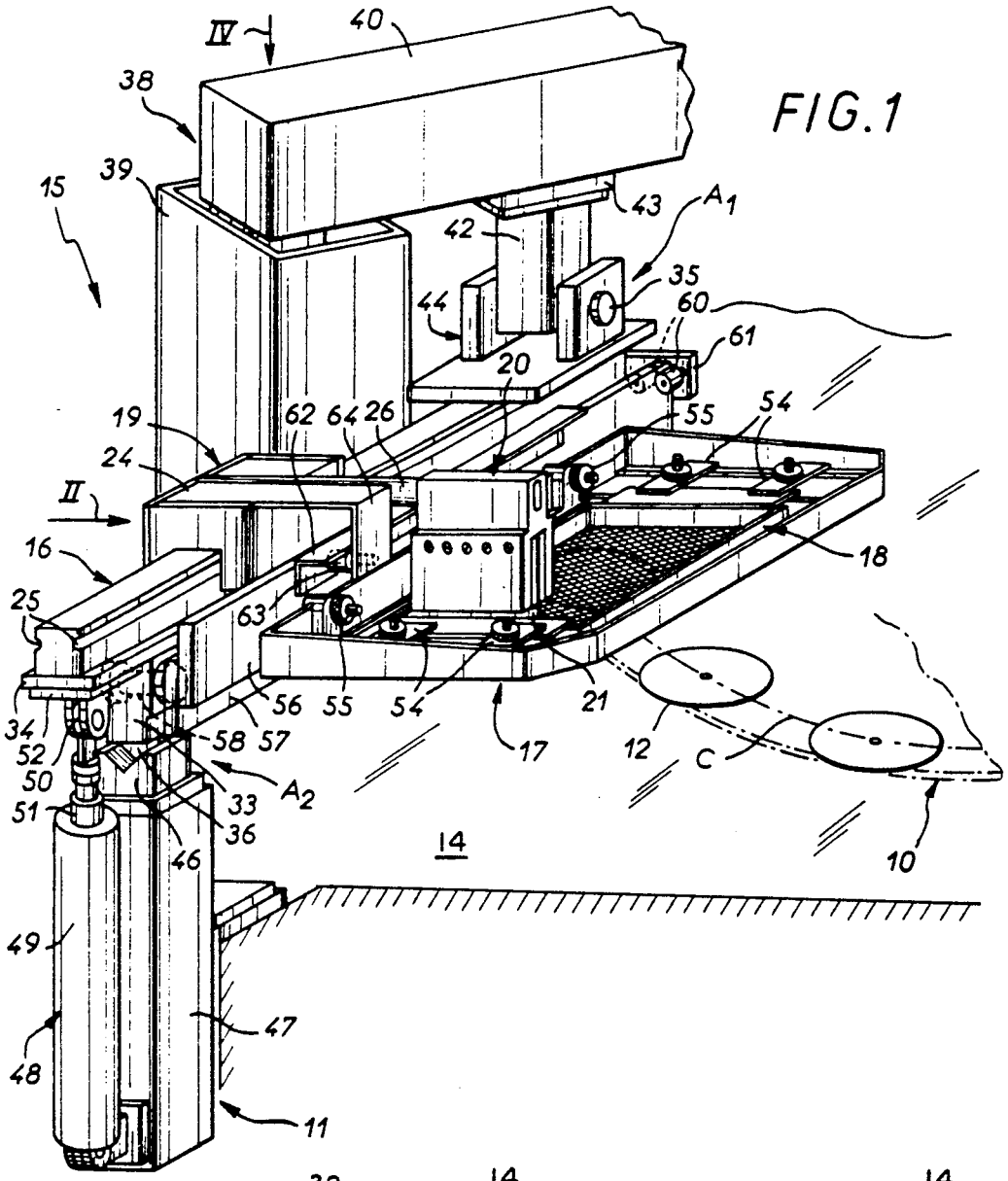
FIG. 1 is a locally cut away partial perspective view of a printing machine in accordance with the invention.
Figure 7:
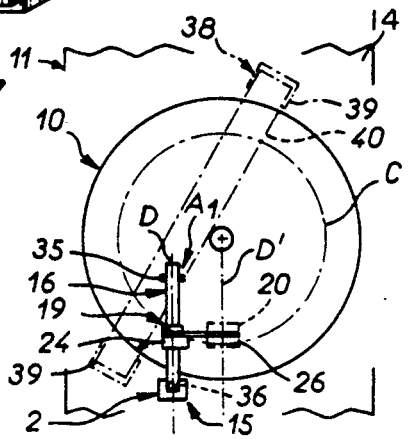
FIG. 7 is a schematic representation of the plan view from FIG. 6.
Figure 6:
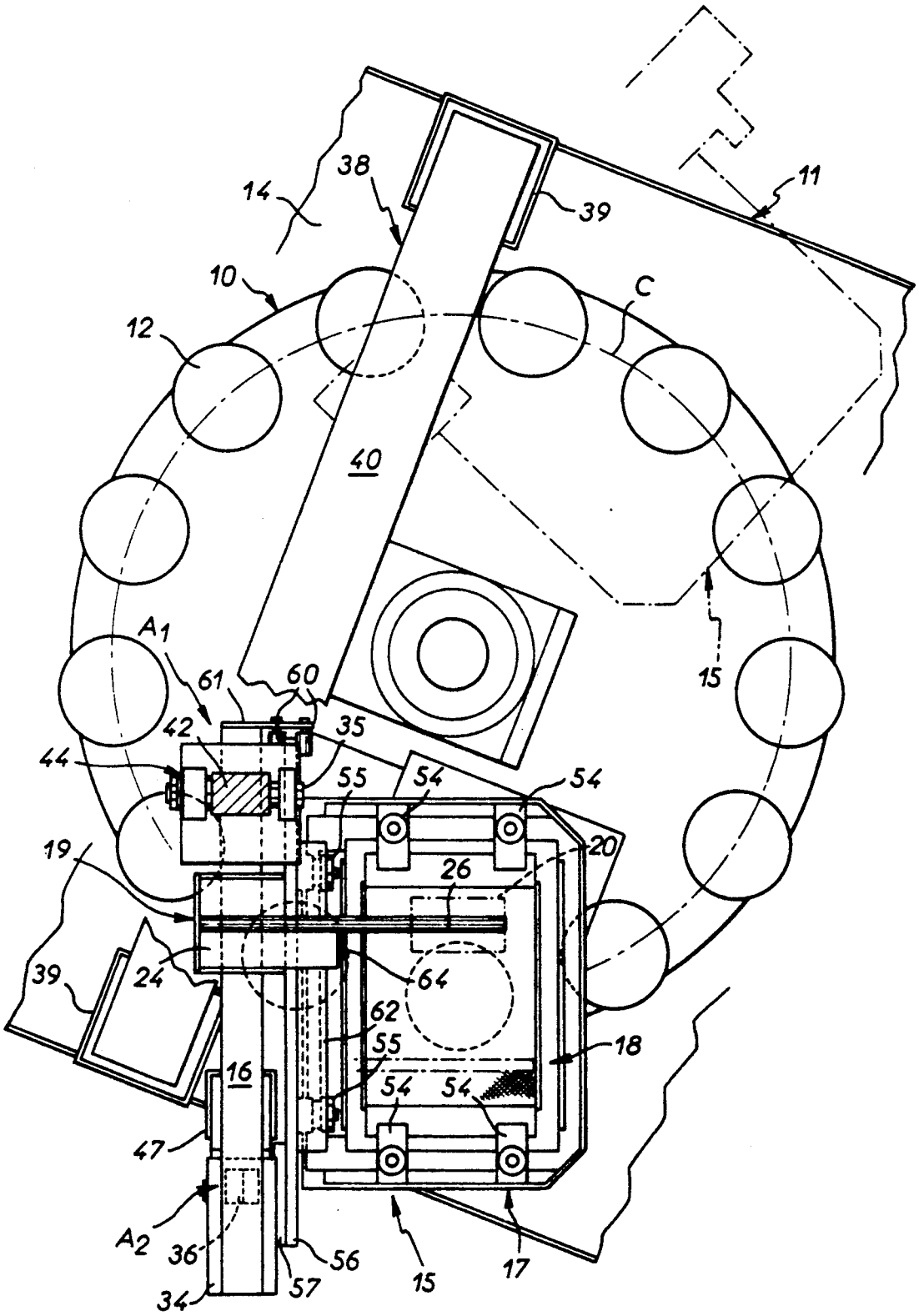
FIG. 6 is a locally cut away partial plan view as seen in the direction of the arrow IV in FIG. 1.

A printing machine in accordance with the invention comprises a turntable 10 which rotates stepwise on a frame 11 and is adapted to move objects to be printed along a circumference C referred to in this document as the displacement circumference and shown in chain-dotted outline in FIGS. 1, 6 and 7. The turntable 10 comprises, equi-angularly spaced along the displacement circumference C, a plurality of object supports 12 each adapted to receive one object to be printed.

To simplify the drawings, the object supports 12 are shown with a circular contour on the assumption that the objects to be printed are disks.

It is obvious, however, that they can have any other contour or form, particularly if the objects to be printed are three-dimensional rather than flat.

The frame 11 includes a table 14 supporting the turntable 10.

As the construction of the turntable 10, the frame 11 and the object supports 12 are all well known in themselves and do not form any part of the present invention, they will not be described here.

At least one silkscreen type printing head 15 is disposed in line with the turntable 10 on the displacement circumference C.

The printing head 15 comprises, carried by the same support beam 16, a screen support 17 adapted to receive a screen 18 and a squeegee carriage 19 adapted to receive a squeegee unit 20 and movable relative to the screen support 17.

As the construction of the squeegee unit 20 is well known in itself and does not form any part of the present invention it will not be described here.

Suffice to say that, as shown in FIG. 1, the squeegee unit 20 is adapted to apply a squeegee 21 to the screen 18.

According to the invention, and as shown diagrammatically in FIG. 7, the support beam 16 of the print head 15, which is straight, extends along a line that is parallel to and displaced from a diameter line of the displacement circumference C. It is coupled to the frame 11 at two points A1, A2 on the latter on respective sides of the displacement circumference C and the squeegee carriage 19 is mobile parallel to the support beam 16.

As shown in chain-dotted line in FIG. 7, the support beam 16 is elongate in a direction D and the squeegee unit 20 is mobile in a direction D'.

It follows from what has just been said that, according to the invention, the directions D and D' are parallel.

The direction D' of displacement of the squeegee unit 20 is a radial direction relative to the displacement circumference C and so the latter can advantageously be printed along their largest dimension.

The squeegee carriage 19 of the printing head 15 incorporates a slide member 24 which slides directly on the support beam 16.

This may be a THK slide ball bearing, for example.

In this case the support beam 16 has a square transverse cross-section, as shown here, with back-to-back grooves 25 on respective sides.

In addition to the slide member 24, the squeegee carriage 19 includes a bar to support the squeegee unit 20 carried by the slide member 24 and extending perpendicular to the support beam 16. The squeegee unit 20 is adjustable in position on the support bar 26.

Over at least part of its length the support beam 16 runs parallel to the tube 28 of a linear drive device 29 (usually referred to as a "rodless jack") whose body 30 is attached by means of a flange 31 to the slide member 24 of the squeegee carriage 19. This device drives the squeegee carriage.

At one end (at the point A1 on the frame 11), the tube 28 is fastened to a bracket 32 attached to the lower surface of the respective end of the support beam 16.

At its other end (at the point A2 on the frame 11), it is inserted into a block 33 which is attached by means of a baseplate 34 to the lower surface of the respective end of the support beam 16.

At point A1 on the frame 11 the support beam 16 is articulated to the frame 11 about a shaft 35. At the point A2 on the frame 11 it bears on the frame through a centering wedge 36.

The point A1 on the frame is inside the displacement circumference C.

In the embodiment shown in FIGS. 1 through 7 the carriage 19 includes a boom 38 carried by the table 14 and extending over the latter, with legs 39 to either side of the turntable 10.

The support beam 16 of the printing head 15 is oblique to the longitudinal member 40 of the boom 38, to avoid the corresponding leg 39.

The pivot shaft 35 is carried by a suspension member 42 which is attached by means of a baseplate 43 to the lower surface of the longitudinal member 40. The support beam 16 of the printing head 15 is fastened to it by means of a yoke 44 attached to its upper surface.

At the point A2 on the frame 11, which is outside the displacement circumference C, the centering wedge 36 is attached to the lower surface of the block 33 which carries the respective end of the support beam 16.

The centering wedge 36 is formed by two flat surfaces 45 parallel to the support beam 16 converging obliquely in the direction towards the turntable 14 of the frame 11.

The centering wedge ,36 is adapted to be nested within a complementary centering recess 46 provided for this purpose at the top of a support 47 carried by the frame 11.

A lifting jack 48 parallel to the support 47 is coupled to the support beam 16 in order to raise the whole assembly.

The body 49 of the lifting jack 48 is articulated at the bottom to the support 47. Its rod 51 is articulated to the respective end of the support beam 16 by means of a lug 50 and a yoke 52 attached for this purpose, with the block 33, to the baseplate 34 at this end of the support beam 16.

Figure 2:
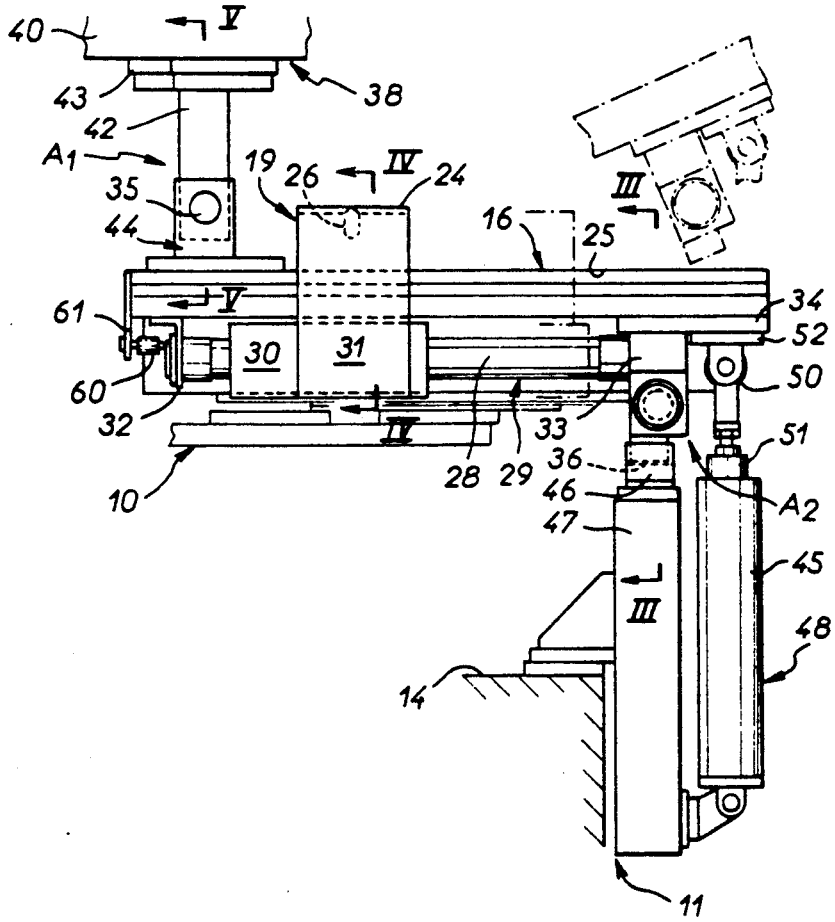
FIG. 2 is a partial view of it to a different scale and as seen in elevation in the direction of the arrow II in FIG. 1.
Figure 3:
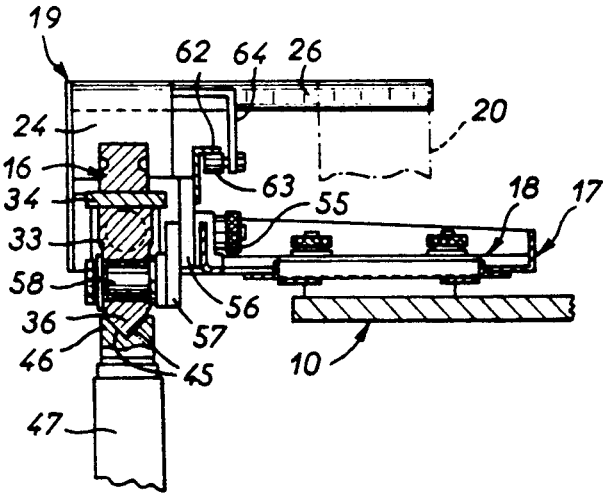
FIGS. 3, 4 and 5 are partial views of it in transverse cross-section on the respective lines III—III, IV—IV and V—V in FIG. 2.
Figure 4:
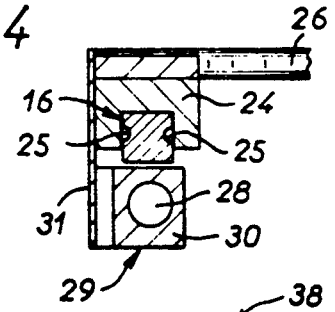
Figure 5:
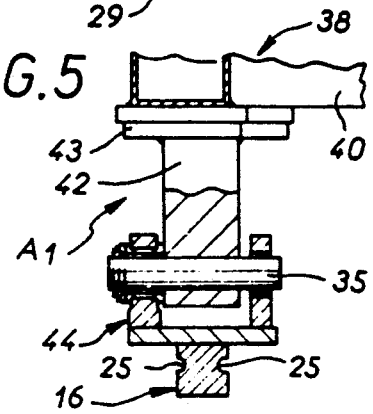

When, as shown in full outline in FIG. 2, the support beam 16 is in the lowered or service position, the points A1 and A2 on the frame 11 at which the shaft 35 and the centering wedge 36 are located constitute anchor points whereby its positioning relative to the frame 11 is particularly precise, firm, stable and secure.

In a way that is known in itself, the screen support 17 is in the form of a frame onto the open back of which the screen 18 is applied by lugs 54.

To raise the screen 18 progressively during printing, and therefore during displacement of the squeegee carriage 19 to carry out the printing, the screen support 17 is articulated to the support beam 16.

To this end it is attached by screws 55 to a rule 56 which is fastened at one end by a spacer plate 57 to a shaft 58 pivoting in the block 33, above the centering wedge 36; its other end is grasped between two guide rollers 60 rotating on a plate 61 projecting at right angles from the respective end of the support beam 16.

Cam means parallel to the support beam 16 are provided between the screen support 17 and the squeegee carriage 19 to bring about the necessary progressive raising of the screen 18.

They comprise a bracket 62 fastened to the rule 56 and extending obliquely relative to the back of the screen support 17 and a roller 63 rotatably mounted on a boom 64 attached to the slide member 24 of the squeegee carriage 19 and bearing on the lower surface of the projecting flange of the bracket 62.

When, with the turntable 10 stopped, the squeegee carriage 19 is moved by the body 30 of the linear drive device 29 along the support beam 16, and the squeegee 21 of the squeegee unit 20 is accordingly moved in contact with the screen 18 to print the underlying object to be printed, as said printing proceeds the screen support 17 is progressively raised so that the screen 18 is progressively removed from the object being printed.

The overhang of the squeegee unit 20 relative to the support beam 16, which is minimal, advantageously remains constant throughout printing.

If required, and as shown in chain-dotted outline in FIG. 2, the lifting jack 48 makes it possible to obtain access to the lower surface of the screen 18, to clean it.

Also if required, and as shown in chain-dotted outline in FIG. 6, two printing heads 15 may be provided, to enable printing in two colours, for example.

The boom 38 is then common to the two printing heads 15.

The advantages of the simple design of the printing head and the resulting compact radial overall dimensions of the printing machine to which it is fitted will be appreciated.

Figure 8:
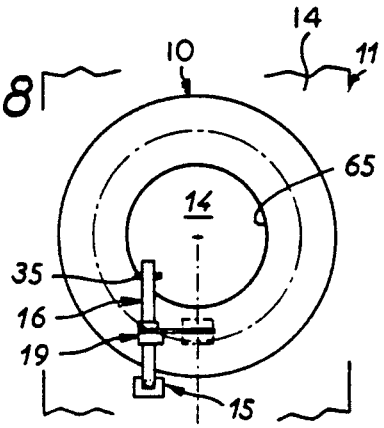
FIG. 8 is a schematic representation similar to that of FIG. 7 for a different embodiment.

In the embodiment shown diagrammatically in figure 8, the turntable 10 is annular and so has an opening 65 in its central area through which the support beam 16 of the printing head 15 can be articulated direct to the underlying table 14.

It is not necessary to use any form of boom.

Otherwise, the arrangements are similar to those previously described.

The present invention is not limited to the embodiments described and shown, but encompasses any variant execution thereof.

Likewise, its applications are not limited to printing flat objects, but encompass the printing of three-dimensional objects.

There is claimed:

1. Printing machine comprising a frame, a turntable for receiving objects to be printed, said turntable being rotatable on said frame for displacing objects to be printed along a displacement circumference, at least one screen type printing head disposed in alignment with a portion of the displacement circumference, the displacement circumference having a center, a support beam, a screen support for receiving a printing screen being carried by said support beam, a squeegee carriage mounted for movement relative to the screen support, said support beam extending along a line that is parallel to and displaced from a diameter line of the displacement circumference, said support beam being coupled to the frame at least two locations, a first of said locations being disposed radially outwardly of a point on said displacement circumference and a second of sid locations being disposed radially inwardly of the point on said displacement circumference, said squeegee carriage being mounted for movement parallel to said support beam and circumferentially spaced therefrom.

2. Printing machine according to claim 1, wherein said support beam is coupled to said frame at one of said first and second locations by an articulation and is coupled to said frame at another of said first and second of locations by a centering wedge.

3. Printing machine according to claim 2, wherein said one location is said first location.

4. Printing machine according to claim 2, wherein said frame comprises a table for supporting the turntable and a boom for articulating the support beam, said boom spanning over the table and having legs fixed at opposite sides of the table.

5. Printing machine according to claim 4, wherein said table is annular and defines a central opening, and said support beam is articulated to said frame through the central opening.

6. Printing machine according to claim 2, wherein said centering wedge comprises two surfaces inclined to each other, said two surfaces extending parallel to said support beam.

7. Printing machine according to claim 1, further comprising a lifting actuator coupled to said support beam for displacement between raised and lowered positions.

8. Printing machine according to claim 1, wherein said screen support is articulated to said support beam, and said printing machine further comprising cam means oriented parallel to said support beam and operatively disposed between said screen support and said squeegee carriage for progressively raising said screen support during movement of said squeegee carriage.

9. Printing machine according to claim 1, wherein said squeegee carriage includes a slide member slidably mounted directly on said support beam.

10. Printing machine according to claim 9, further comprising a linear drive means for driving the squeegee carriage having a body coupled to said squeegee carriage and a tube which runs parallel to at least part of said support beam and is fixed relative to said support beam.

* * * * *